US011328735B2

(12) United States Patent
Laaksonen et al.

(10) Patent No.: US 11,328,735 B2
(45) Date of Patent: May 10, 2022

(54) DETERMINATION OF SPATIAL AUDIO PARAMETER ENCODING AND ASSOCIATED DECODING

(71) Applicant: Nokia Technologies Oy, Espoo (FI)

(72) Inventors: Lasse Juhani Laaksonen, Tampere (FI); Anssi Sakari Rämö, Tampere (FI); Adriana Vasilache, Tampere (FI); Mikko Tammi, Tampere (FI); Miikka Vilermo, Siuro (FI)

(73) Assignee: NOKIA TECHNOLOGIES OY, Espoo (FI)

( * ) Notice: Subject to any disclaimer, the term of this patent is extended or adjusted under 35 U.S.C. 154(b) by 0 days.

(21) Appl. No.: 16/762,389

(22) PCT Filed: Nov. 10, 2017

(86) PCT No.: PCT/EP2017/078948

§ 371 (c)(1),
(2) Date: May 7, 2020

(87) PCT Pub. No.: WO2019/091575

PCT Pub. Date: May 16, 2019

(65) Prior Publication Data

US 2020/0273467 A1 Aug. 27, 2020

(51) Int. Cl.

| | |
|---|---|
| ***G10L 19/008*** | (2013.01) |
| ***G10L 19/032*** | (2013.01) |
| ***H04S 3/02*** | (2006.01) |

(52) U.S. Cl.

CPC ..... *G10L 19/008* (2013.01); *G10L 19/032* (2013.01); *H04S 3/02* (2013.01)

(58) Field of Classification Search

CPC ... G10L 19/008; G10L 19/167; G10L 19/032; G10L 19/038; G10L 19/22

(Continued)

(56) References Cited

U.S. PATENT DOCUMENTS

| | | | | |
|---|---|---|---|---|
| 9,699,583 | B1 * | 7/2017 | Lyren | H04S 7/303 |
| 2007/0067162 | A1 * | 3/2007 | Villemoes | G10L 19/008 704/206 |

(Continued)

OTHER PUBLICATIONS

International Search Report and Written Opinion received for corresponding Patent Cooperation Treaty Application No. PCT/EP2017/078948, dated Jan. 29, 2018, 11 pages.

(Continued)

*Primary Examiner* — Alexander Krzystan
(74) *Attorney, Agent, or Firm* — Alston & Bird LLP

(57) ABSTRACT

An apparatus for spatial audio signal encoding, the apparatus comprising at least one processor and at least one memory including a computer program code, the at least one memory and the computer program code configured to, with the at least one processor, cause the apparatus at least to: determine, for two or more audio signals, at least one spatial audio parameter for providing spatial audio reproduction, the at least one spatial audio parameter comprising a direction parameter with an elevation and an azimuth component; define a spherical grid generated by covering a sphere with smaller spheres, wherein the centres of the smaller spheres define points of the spherical grid; and convert the elevation and azimuth component of the direction parameter to an index value based on the defined spherical grid.

20 Claims, 13 Drawing Sheets

(58) Field of Classification Search
USPC ..... 381/310, 23, 22, 309, 306
See application file for complete search history.

(56) References Cited

U.S. PATENT DOCUMENTS

| | | | | |
|---|---|---|---|---|
| 2008/0170711 | A1* | 7/2008 | Breebaart | G10L 19/008 381/77 |
| 2012/0114126 | A1* | 5/2012 | Thiergart | G10L 21/0272 381/17 |
| 2012/0213375 | A1* | 8/2012 | Mahabub | H04S 5/00 381/17 |
| 2014/0358557 | A1* | 12/2014 | Sen | G10L 19/008 704/500 |
| 2016/0189723 | A1* | 6/2016 | Davis | G10L 19/005 704/501 |
| 2016/0217800 | A1* | 7/2016 | Purnhagen | H04W 28/065 |
| 2020/0077222 | A1* | 3/2020 | Nguyen | H04R 5/033 |

OTHER PUBLICATIONS

Li et al., "The Perceptual Lossless Quantization of Spatial Parameter for 3D Audio Signals", International Conference on Multimedia Modeling, 2017, pp. 381-392.
Yang et al., "3D Audio Coding Approach Based on Spatial Perception Features", China Communications, vol. 14, No. 11, Nov. 2017, pp. 126-140.

* cited by examiner

DETERMINATION OF SPATIAL AUDIO PARAMETER ENCODING AND ASSOCIATED DECODING

RELATED APPLICATION

This application claims priority to PCT Application No. PCT/EP2017/078948, filed on Nov. 10, 2017, of which is incorporated herein by reference in its entirety.

FIELD

The present application relates to apparatus and methods for sound-field related parameter encoding, but not exclusively for time-frequency domain direction related parameter encoding for an audio encoder and decoder.

BACKGROUND

Parametric spatial audio processing is a field of audio signal processing where the spatial aspect of the sound is described using a set of parameters. For example, in parametric spatial audio capture from microphone arrays, it is a typical and an effective choice to estimate from the microphone array signals a set of parameters such as directions of the sound in frequency bands, and the ratios between the directional and non-directional parts of the captured sound in frequency bands. These parameters are known to well describe the perceptual spatial properties of the captured sound at the position of the microphone array. These parameters can be utilized in synthesis of the spatial sound accordingly, for headphones binaurally, for loudspeakers, or to other formats, such as Ambisonics.

The directions and direct-to-total energy ratios in frequency bands are thus a parameterization that is particularly effective for spatial audio capture.

A parameter set consisting of a direction parameter in frequency bands and an energy ratio parameter in frequency bands (indicating the directionality of the sound) can be also utilized as the spatial metadata for an audio codec. For example, these parameters can be estimated from microphone-array captured audio signals, and for example a stereo signal can be generated from the microphone array signals to be conveyed with the spatial metadata. The stereo signal could be encoded, for example, with an AAC encoder. A decoder can decode the audio signals into PCM signals, and process the sound in frequency bands (using the spatial metadata) to obtain the spatial output, for example a binaural output.

The aforementioned solution is particularly suitable for encoding captured spatial sound from microphone arrays (e.g., in mobile phones, VR cameras, stand-alone microphone arrays). However, it may be desirable for such an encoder to have also other input types than microphone-array captured signals, for example, loudspeaker signals, audio object signals, or Ambisonic signals.

Analysing first-order Ambisonics (FOA) inputs for spatial metadata extraction has been thoroughly documented in scientific literature related to Directional Audio Coding (DirAC) and Harmonic planewave expansion (Harpex). This is since there exist microphone arrays directly providing a FOA signal (more accurately: its variant, the B-format signal), and analysing such an input has thus been a point of study in the field.

A further input for the encoder is also multi-channel loudspeaker input, such as 5.1 or 7.1 channel surround inputs.

However with respect to the directional components of the metadata, which may comprise an elevation, azimuth (and diffuseness) of a resulting direction, for each considered time/frequency subband a quantization and/or encoding which implements uniform granularity along the azimuth and the elevation components separately (when these two parameters are separately added to the metadata) can result in an uneven distribution of quantization and encoding states. For example a uniform approach to both separately results in an encoding scheme with a higher density nearer the 'poles' of the direction sphere, in other words directly above or below the locus or reference location.

SUMMARY

There is provided according to an apparatus for spatial audio signal encoding, the apparatus comprising at least one processor and at least one memory including a computer program code, the at least one memory and the computer program code configured to, with the at least one processor, cause the apparatus at least to: determine, for two or more audio signals, at least one spatial audio parameter for providing spatial audio reproduction, the at least one spatial audio parameter comprising a direction parameter with an elevation and an azimuth component; define a spherical grid generated by covering a sphere with smaller spheres, wherein the centres of the smaller spheres define points of the spherical grid; and convert the elevation and azimuth component of the direction parameter to an index value based on the defined spherical grid.

The apparatus caused to define a spherical grid generated by covering a sphere with smaller spheres, wherein the centres of the smaller spheres define points of the spherical grid may be further caused to: select a determined number of the smaller spheres for a first cross-section circle of the sphere, the first cross-section circle defined by a diameter of the sphere; and determine a further number of cross-section circles of the sphere and select for each of the further number of cross-section circles of the sphere further numbers of the smaller spheres.

The first cross-section circle defined by a diameter of the sphere may be one of: an equator of the sphere; a plane intersecting the centre of the sphere; any circle having the same centre as the sphere, and being situated on the sphere surface; and a meridian of the sphere.

The apparatus caused to define a spherical grid generated by covering a sphere with smaller spheres, wherein the centres of the smaller spheres define points of the spherical grid may be further caused to define a circle index order associated with the first cross-section circle and the further number of cross-section circles.

The spacing of the smaller spheres over the sphere may be approximately equidistant with respect to the smaller spheres.

The determined number of the smaller spheres for a first cross-section circle of the sphere and further numbers of the smaller spheres may be determined based on an input quantization value.

The apparatus caused to convert the elevation and azimuth component of the direction parameter to an index value based on the defined spherical grid may be further caused to: determine a cross-section circle index value based on a defined order of the elevation component of the direction parameter; determine an intra-circle index value based on the azimuth component of the direction parameter;

and generate an index value based on combining the intra-circle index value and an offset value based on the cross-section circle index value.

According to a second aspect there is provided an apparatus for spatial audio signal decoding, the apparatus comprising at least one processor and at least one memory including a computer program code, the at least one memory and the computer program code configured to, with the at least one processor, cause the apparatus at least to: determine, the at least one direction index associated with two or more audio signals for providing spatial audio reproduction, the at least one direction index representing a spatial parameter with an elevation and an azimuth component; determine a spherical grid generated by covering a sphere with smaller spheres, wherein the centres of the smaller spheres define points of the spherical grid; and convert the at least one direction index to a quantized elevation and a quantized azimuth representation of the elevation and the azimuth component of the direction parameter to an index value based on the determined spherical grid.

The apparatus caused to determine a spherical grid generated by covering a sphere with smaller spheres, wherein the centres of the smaller spheres define points of the spherical grid may be further caused to: select a determined number of the smaller spheres for a first cross-section circle of the sphere, the first cross-section circle defined by a diameter of the sphere; and determine a further number of cross-section circles of the sphere and select for each of the further number of cross-section circles of the sphere further numbers of the smaller spheres.

The first cross-section circle defined by a diameter of the sphere may be one of: an equator of the sphere; a plane intersecting the centre of the sphere; any circle having the same centre as the sphere, and being situated on the sphere surface; and a meridian of the sphere.

The apparatus caused to define a spherical grid generated by covering a sphere with smaller spheres, wherein the centres of the smaller spheres define points of the spherical grid may be further caused to define a circle index order associated with the first cross-section circle and the further number of cross-section circles.

The spacing of the smaller spheres over the sphere may be approximately equidistant with respect to the smaller spheres.

The determined number of the smaller spheres for a first cross-section circle of the sphere and further numbers of the smaller spheres may be determined based on an input quantization value.

The apparatus caused to convert the at least one direction index to a quantized elevation and a quantized azimuth representation of the elevation and the azimuth component of the direction parameter to an index value based on the determined spherical grid may be further caused to: determine a cross-section circle index value based on the index value; determine the quantized elevation representation of the elevation component based on the cross-section circle index value; and generate the quantized azimuth representation of the azimuth component based on a remainder index value after removing an offset associated with the cross-section circle index value from the index value.

According to a third aspect there is provided a method for spatial audio signal encoding, the method comprising: determining, for two or more audio signals, at least one spatial audio parameter for providing spatial audio reproduction, the at least one spatial audio parameter comprising a direction parameter with an elevation and an azimuth component; defining a spherical grid generated by covering a sphere with smaller spheres, wherein the centres of the smaller spheres define points of the spherical grid; and converting the elevation and azimuth component of the direction parameter to an index value based on the defined spherical grid.

Defining a spherical grid generated by covering a sphere with smaller spheres, wherein the centres of the smaller spheres define points of the spherical grid may comprise: selecting a determined number of the smaller spheres for a first cross-section circle of the sphere, the first cross-section circle defined by a diameter of the sphere; and determining a further number of cross-section circles of the sphere and select for each of the further number of cross-section circles of the sphere further numbers of the smaller spheres.

The first cross-section circle defined by a diameter of the sphere may be one of: an equator of the sphere; a plane intersecting the centre of the sphere; any circle having the same centre as the sphere, and being situated on the sphere surface; and a meridian of the sphere.

Defining a spherical grid generated by covering a sphere with smaller spheres, wherein the centres of the smaller spheres define points of the spherical grid may comprise defining a circle index order associated with the first cross-section circle and the further number of cross-section circles.

The spacing of the smaller spheres over the sphere may be approximately equidistant with respect to the smaller spheres.

The determined number of the smaller spheres for a first cross-section circle of the sphere and further numbers of the smaller spheres may be determined based on an input quantization value.

Converting the elevation and azimuth component of the direction parameter to an index value based on the defined spherical grid may further comprise: determining a cross-section circle index value based on a defined order of the elevation component of the direction parameter; determining an intra-circle index value based on the azimuth component of the direction parameter; and generating an index value based on combining the intra-circle index value and an offset value based on the cross-section circle index value.

According to a fourth aspect there is provided a method for spatial audio signal decoding, the method comprising: determining, the at least one direction index associated with two or more audio signals for providing spatial audio reproduction, the at least one direction index representing a spatial parameter with an elevation and an azimuth component; determining a spherical grid generated by covering a sphere with smaller spheres, wherein the centres of the smaller spheres define points of the spherical grid; and converting the at least one direction index to a quantized elevation and a quantized azimuth representation of the elevation and the azimuth component of the direction parameter to an index value based on the determined spherical grid.

Determining a spherical grid generated by covering a sphere with smaller spheres, wherein the centres of the smaller spheres define points of the spherical grid further may comprise: selecting a determined number of the smaller spheres for a first cross-section circle of the sphere, the first cross-section circle defined by a diameter of the sphere; and determining a further number of cross-section circles of the sphere and select for each of the further number of cross-section circles of the sphere further numbers of the smaller spheres.

The first cross-section circle defined by a diameter of the sphere may be one of: an equator of the sphere; a plane intersecting the centre of the sphere; any circle having the same centre as the sphere, and being situated on the sphere surface; and a meridian of the sphere.

Defining a spherical grid generated by covering a sphere with smaller spheres, wherein the centres of the smaller spheres define points of the spherical grid may further comprise defining a circle index order associated with the first cross-section circle and the further number of cross-section circles.

The spacing of the smaller spheres over the sphere may be approximately equidistant with respect to the smaller spheres.

The determined number of the smaller spheres for a first cross-section circle of the sphere and further numbers of the smaller spheres may be determined based on an input quantization value.

Converting the at least one direction index to a quantized elevation and a quantized azimuth representation of the elevation and the azimuth component of the direction parameter to an index value based on the determined spherical grid further may comprise: determining a cross-section circle index value based on the index value; determining the quantized elevation representation of the elevation component based on the cross-section circle index value; and generating the quantized azimuth representation of the azimuth component based on a remainder index value after removing an offset associated with the cross-section circle index value from the index value.

According to a fifth aspect there is provided an apparatus for spatial audio signal encoding, the apparatus comprising: means for determining, for two or more audio signals, at least one spatial audio parameter for providing spatial audio reproduction, the at least one spatial audio parameter comprising a direction parameter with an elevation and an azimuth component; means for defining a spherical grid generated by covering a sphere with smaller spheres, wherein the centres of the smaller spheres define points of the spherical grid; and means for converting the elevation and azimuth component of the direction parameter to an index value based on the defined spherical grid.

The means for defining a spherical grid generated by covering a sphere with smaller spheres, wherein the centres of the smaller spheres define points of the spherical grid may comprise: means for selecting a determined number of the smaller spheres for a first cross-section circle of the sphere, the first cross-section circle defined by a diameter of the sphere; and means for determining a further number of cross-section circles of the sphere and select for each of the further number of cross-section circles of the sphere further numbers of the smaller spheres.

The first cross-section circle defined by a diameter of the sphere may be one of: an equator of the sphere; any circle having the same centre as the sphere, and being situated on the sphere surface; and a meridian of the sphere.

The means for defining a spherical grid generated by covering a sphere with smaller spheres, wherein the centres of the smaller spheres define points of the spherical grid may comprise means for defining a circle index order associated with the first cross-section circle and the further number of cross-section circles.

The spacing of the smaller spheres over the sphere may be approximately equidistant with respect to the smaller spheres.

The determined number of the smaller spheres for a first cross-section circle of the sphere and further numbers of the smaller spheres may be determined based on an input quantization value.

The means for converting the elevation and azimuth component of the direction parameter to an index value based on the defined spherical grid may further comprise: means for determining a cross-section circle index value based on a defined order of the elevation component of the direction parameter; means for determining an intra-circle index value based on the azimuth component of the direction parameter; and generating an index value based on combining the intra-circle index value and an offset value based on the cross-section circle index value.

According to a sixth aspect there is provided an apparatus for spatial audio signal decoding, the apparatus comprising: means for determining, the at least one direction index associated with two or more audio signals for providing spatial audio reproduction, the at least one direction index representing a spatial parameter with an elevation and an azimuth component; means for determining a spherical grid generated by covering a sphere with smaller spheres, wherein the centres of the smaller spheres define points of the spherical grid; and means for converting the at least one direction index to a quantized elevation and a quantized azimuth representation of the elevation and the azimuth component of the direction parameter to an index value based on the determined spherical grid.

The means for determining a spherical grid generated by covering a sphere with smaller spheres, wherein the centres of the smaller spheres define points of the spherical grid may further comprise: means for selecting a determined number of the smaller spheres for a first cross-section circle of the sphere, the first cross-section circle defined by a diameter of the sphere; and means for determining a further number of cross-section circles of the sphere and select for each of the further number of cross-section circles of the sphere further numbers of the smaller spheres.

The first cross-section circle defined by a diameter of the sphere may be one of: an equator of the sphere; any circle having the same centre as the sphere, and being situated on the sphere surface; and a meridian of the sphere.

The means for defining a spherical grid generated by covering a sphere with smaller spheres, wherein the centres of the smaller spheres define points of the spherical grid may further comprise means for defining a circle index order associated with the first cross-section circle and the further number of cross-section circles.

The spacing of the smaller spheres over the sphere may be approximately equidistant with respect to the smaller spheres.

The determined number of the smaller spheres for a first cross-section circle of the sphere and further numbers of the smaller spheres may be determined based on an input quantization value.

The means for converting the at least one direction index to a quantized elevation and a quantized azimuth representation of the elevation and the azimuth component of the direction parameter to an index value based on the determined spherical grid may further comprise: means for determining a cross-section circle index value based on the index value; means for determining the quantized elevation representation of the elevation component based on the cross-section circle index value; and means for generating the quantized azimuth representation of the azimuth component based on a remainder index value after removing an offset associated with the cross-section circle index value from the index value.

An apparatus comprising means for performing the actions of the method as described above.

An apparatus configured to perform the actions of the method as described above.

A computer program comprising program instructions for causing a computer to perform the method as described above.

A computer program product stored on a medium may cause an apparatus to perform the method as described herein.

An electronic device may comprise apparatus as described herein.

A chipset may comprise apparatus as described herein.

Embodiments of the present application aim to address problems associated with the state of the art.

SUMMARY OF THE FIGURES

For a better understanding of the present application, reference will now be made by way of example to the accompanying drawings in which.

EMBODIMENTS OF THE APPLICATION

Figure 1:
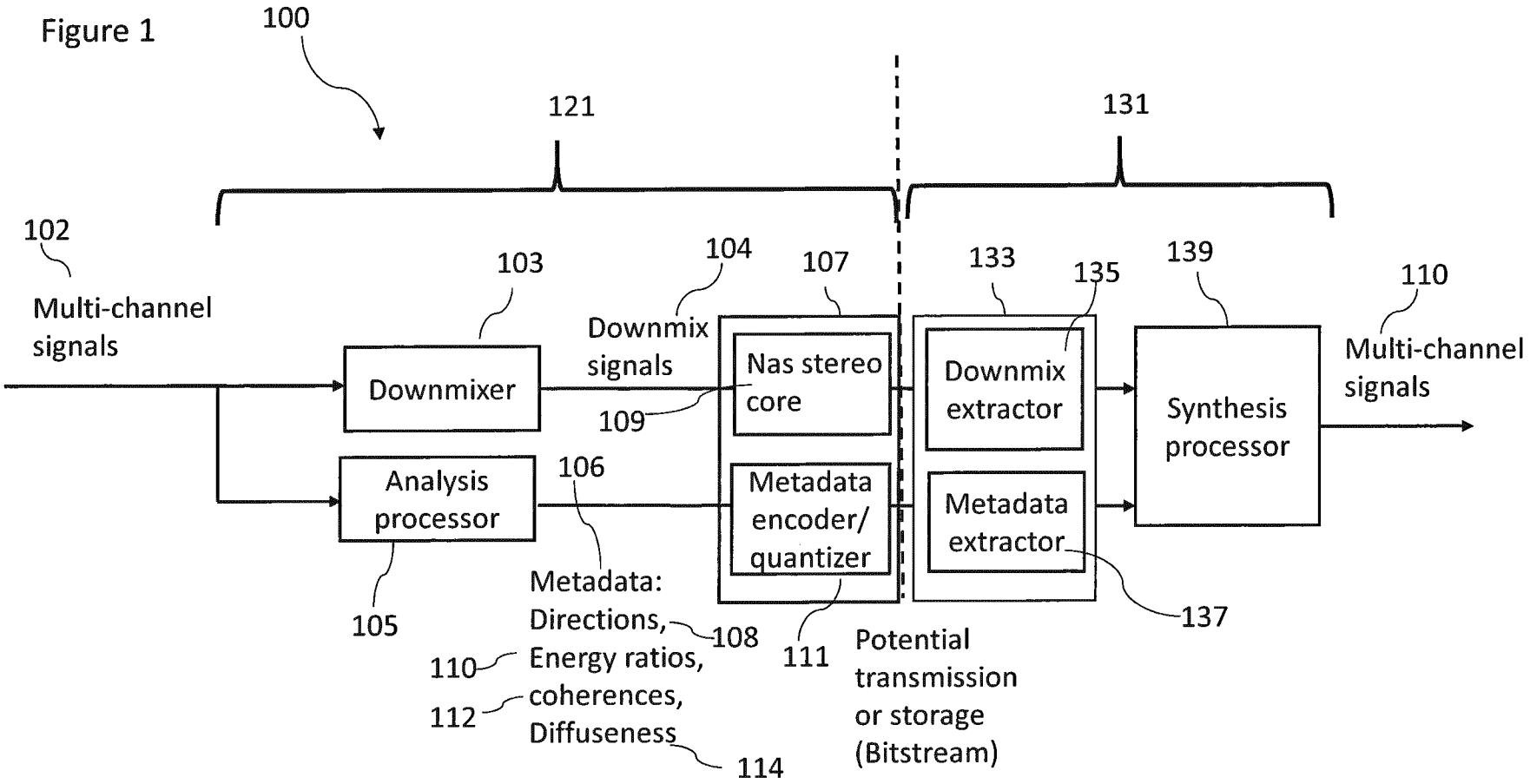
FIG. 1 shows schematically a system of apparatus suitable for implementing some embodiments.

The following describes in further detail suitable apparatus and possible mechanisms for the provision of effective spatial analysis derived metadata parameters for multi-channel input format audio signals. In the following discussions multi-channel system is discussed with respect to a multi-channel microphone implementation. However as discussed above the input format may be any suitable input format, such as multi-channel loudspeaker, ambisonic (FOA/HOA) etc. It is understood that in some embodiments the channel location is based on a location of the microphone or is a virtual location or direction. Furthermore the output of the example system is a multi-channel loudspeaker arrangement. However it is understood that the output may be rendered to the user via means other than loudspeakers. Furthermore the multi-channel loudspeaker signals may be generalised to be two or more playback audio signals.

As discussed previously spatial metadata parameters such as direction and direct-to-total energy ratio (or diffuseness-ratio, absolute energies, or any suitable expression indicating the directionality/non-directionality of the sound at the given time-frequency interval) parameters in frequency bands are particularly suitable for expressing the perceptual properties of natural sound fields. Synthetic sound scenes such as 5.1 loudspeaker mixes commonly utilize audio effects and amplitude panning methods that provide spatial sound that differs from sounds occurring in natural sound fields. In particular, a 5.1 or 7.1 mix may be configured such that it contains coherent sounds played back from multiple directions. For example, it is common that some sounds of a 5.1 mix perceived directly at the front are not produced by a centre (channel) loudspeaker, but for example coherently from left and right front (channels) loudspeakers, and potentially also from the centre (channel) loudspeaker. The spatial metadata parameters such as direction(s) and energy ratio(s) do not express such spatially coherent features accurately. As such other metadata parameters such as coherence parameters may be determined from analysis of the audio signals to express the audio signal relationships between the channels.

As expressed above an example of the incorporation of the direction information in the metadata is to use determined azimuth and elevation values. However conventional uniform azimuth and elevation sampling produces a non uniform direction distribution.

The concept it thus an attempt to determine a direction parameter for spatial metadata and to index the parameter based on a practical sphere covering based distribution of the directions in order to define a more uniform distribution of directions.

The proposed metadata index may then be used alongside a downmix signal ('channels'), to define a parametric immersive format that can be utilized, e.g., for the IVAS codec. Alternatively and in addition, the spherical grid format can be used in the codec to quantize directions.

The concept furthermore discusses the decoding of such indexed direction parameters to produce quantised directional parameters which can be used in synthesis of spatial audio based on sound-field related parameterization (direction(s) and ratio(s) in frequency bands).

With respect to FIG. 1 an example apparatus and system for implementing embodiments of the application are shown. The system 100 is shown with an 'analysis' part 121 and a 'synthesis' part 131. The 'analysis' part 121 is the part from receiving the multi-channel loudspeaker signals up to an encoding of the metadata and downmix signal and the 'synthesis' part 131 is the part from a decoding of the encoded metadata and downmix signal to the presentation of the re-generated signal (for example in multi-channel loudspeaker form).

The input to the system 100 and the 'analysis' part 121 is the multi-channel signals 102. In the following examples a microphone channel signal input is described, however any suitable input (or synthetic multi-channel) format may be implemented in other embodiments.

The multi-channel signals are passed to a downmixer 103 and to an analysis processor 105.

In some embodiments the downmixer 103 is configured to receive the multi-channel signals and downmix the signals to a determined number of channels and output the downmix signals 104. For example the downmixer 103 may be configured to generate a 2 audio channel downmix of the multi-channel signals. The determined number of channels may be any suitable number of channels. In some embodiments the downmixer 103 is optional and the multi-channel signals are passed unprocessed to an encoder 107 in the same manner as the downmix signal are in this example.

In some embodiments the analysis processor 105 is also configured to receive the multi-channel signals and analyse the signals to produce metadata 106 associated with the multi-channel signals and thus associated with the downmix signals 104. The analysis processor 105 may be configured to generate the metadata which may comprise, for each time-frequency analysis interval, a direction parameter 108, an energy ratio parameter 110, a coherence parameter 112, and a diffuseness parameter 114. The direction, energy ratio and diffuseness parameters may in some embodiments be considered to be spatial audio parameters. In other words the spatial audio parameters comprise parameters which aim to characterize the sound-field created by the multi-channel signals (or two or more playback audio signals in general). The coherence parameters may be considered to be signal relationship audio parameters which aim to characterize the relationship between the multi-channel signals.

In some embodiments the parameters generated may differ from frequency band to frequency band. Thus for example in band X all of the parameters are generated and transmitted, whereas in band Y only one of the parameters is generated and transmitted, and furthermore in band Z no parameters are generated or transmitted. A practical example of this may be that for some frequency bands such as the highest band some of the parameters are not required for perceptual reasons. The downmix signals 104 and the metadata 106 may be passed to an encoder 107.

The encoder 107 may comprise a NAS stereo core 109 which is configured to receive the downmix (or otherwise) signals 104 and generate a suitable encoding of these audio signals. The encoder 107 can in some embodiments be a computer (running suitable software stored on memory and on at least one processor), or alternatively a specific device utilizing, for example, FPGAs or ASICs. The encoding may be implemented using any suitable scheme. The encoder 107 may furthermore comprise a metadata encoder or quantizer 109 which is configured to receive the metadata and output an encoded or compressed form of the information. In some embodiments the encoder 107 may further interleave, multiplex to a single data stream or embed the metadata within encoded downmix signals before transmission or storage shown in FIG. 1 by the dashed line. The multiplexing may be implemented using any suitable scheme.

In the decoder side, the received or retrieved data (stream) may be received by a decoder/demultiplexer 133. The decoder/demultiplexer 133 may demultiplex the encoded streams and pass the audio encoded stream to a downmix extractor 135 which is configured to decode the audio signals to obtain the downmix signals. Similarly the decoder/demultiplexer 133 may comprise a metadata extractor 137 which is configured to receive the encoded metadata and generate metadata. The decoder/demultiplexer 133 can in some embodiments be a computer (running suitable software stored on memory and on at least one processor), or alternatively a specific device utilizing, for example, FPGAs or ASICs.

The decoded metadata and downmix audio signals may be passed to a synthesis processor 139.

The system 100 'synthesis' part 131 further shows a synthesis processor 139 configured to receive the downmix and the metadata and re-creates in any suitable format a synthesized spatial audio in the form of multi-channel signals 110 (these may be multichannel loudspeaker format or in some embodiments any suitable output format such as binaural or Ambisonics signals, depending on the use case) based on the downmix signals and the metadata.

Figure 4:
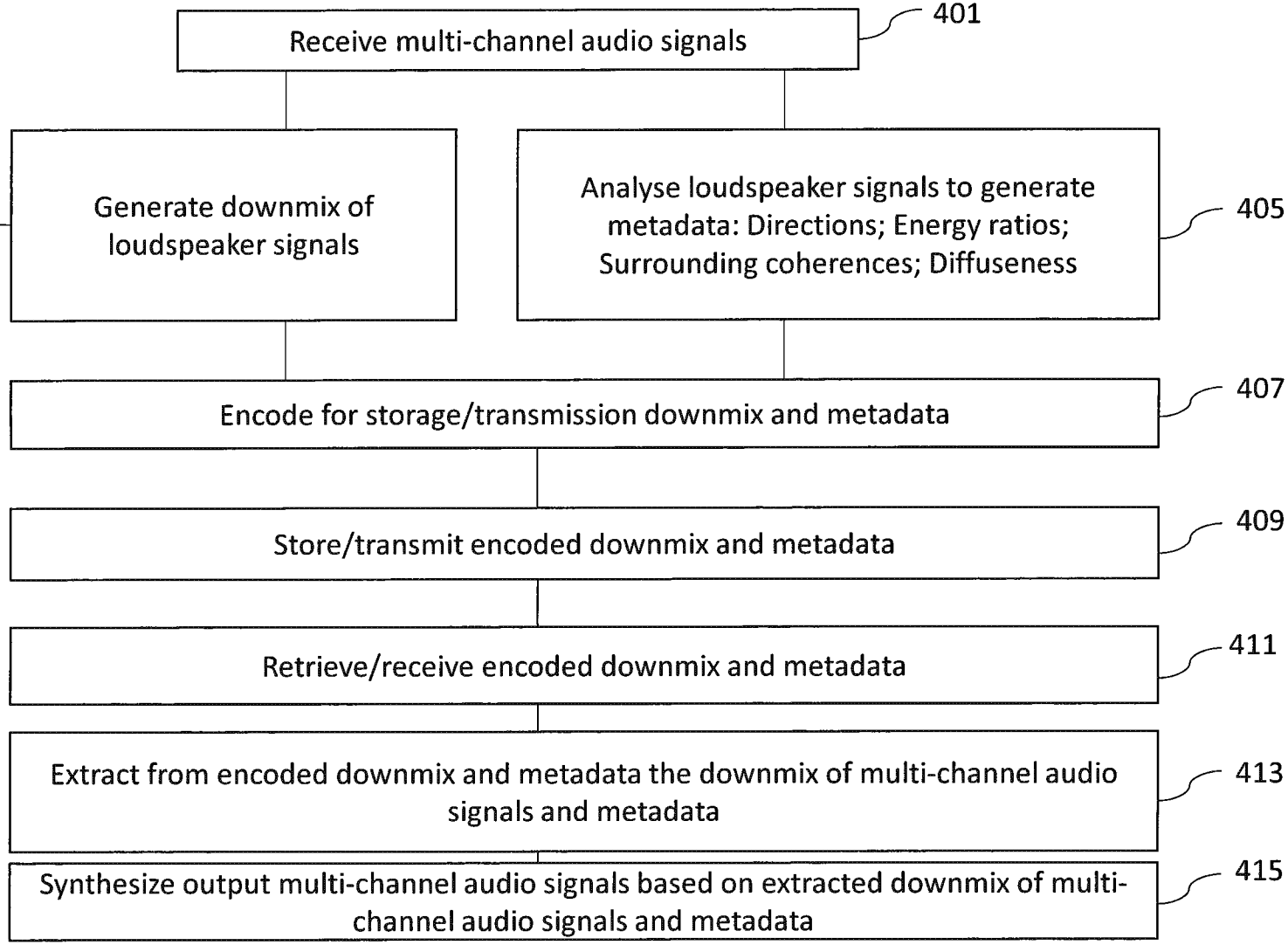
FIG. 4 shows a flow diagram of the operation of the system as shown in FIG. 1 according to some embodiments.

With respect to FIG. 4 an example flow diagram of the overview shown in FIG. 1 is shown.

First the system (analysis part) is configured to receive multi-channel audio signals as shown in FIG. 4 by step 401.

Then the system (analysis part) is configured to generate a downmix of the multi-channel signals as shown in FIG. 4 by step 403.

Also the system (analysis part) is configured to analyse signals to generate metadata such as direction parameters; energy ratio parameters; diffuseness parameters and coherence parameters as shown in FIG. 4 by step 405.

The system is then configured to encode for storage/transmission the downmix signal and metadata as shown in FIG. 4 by step 407.

After this the system may store/transmit the encoded downmix and metadata as shown in FIG. 4 by step 409.

The system may retrieve/receive the encoded downmix and metadata as shown in FIG. 4 by step 411.

Then the system is configured to extract the downmix and metadata from encoded downmix and metadata parameters, for example demultiplex and decode the encoded downmix and metadata parameters, as shown in FIG. 4 by step 413.

The system (synthesis part) is configured to synthesize an output multi-channel audio signal based on extracted downmix of multi-channel audio signals and metadata with coherence parameters as shown in FIG. 4 by step 415.

Figure 2:
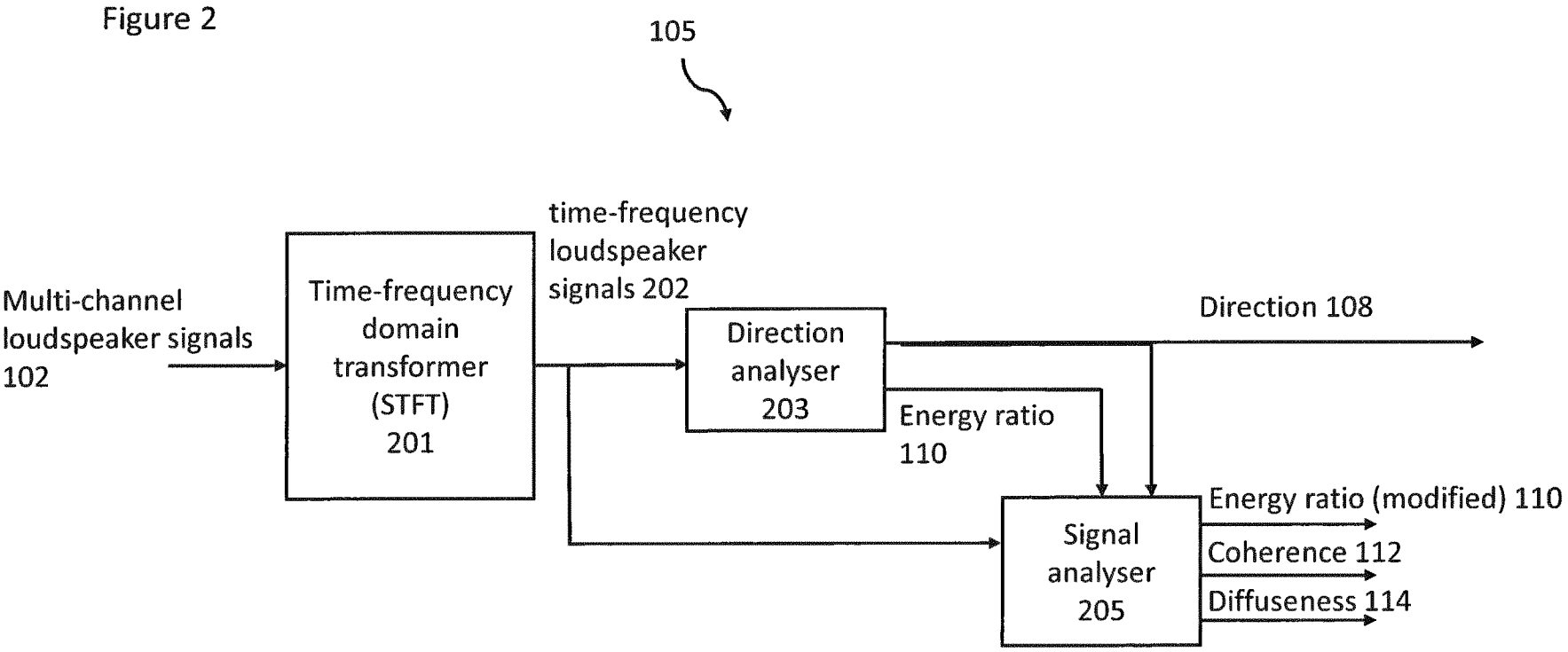
FIG. 2 shows schematically the analysis processor as shown in FIG. 1 according to some embodiments.

With respect to FIG. 2 an example analysis processor 105 (as shown in FIG. 1) according to some embodiments is described in further detail. The analysis processor 105 in some embodiments comprises a time-frequency domain transformer 201.

In some embodiments the time-frequency domain transformer 201 is configured to receive the multi-channel signals 102 and apply a suitable time to frequency domain transform such as a Short Time Fourier Transform (STFT) in order to convert the input time domain signals into a suitable time-frequency signals. These time-frequency signals may be passed to a direction analyser 203 and to a signal analyser 205.

Thus for example the time-frequency signals 202 may be represented in the time-frequency domain representation by $$s_i(b,n),$$

where b is the frequency bin index and n is the frame index and i is the channel index. In another expression, n can be considered as a time index with a lower sampling rate than that of the original time-domain signals. These frequency bins can be grouped into subbands that group one or more of the bins into a band index k=0, . . . , K−1. Each subband k has a lowest bin $b_{k,low}$ and a highest bin $b_{k,high}$, and the subband contains all bins from $b_{k,low}$ to $b_{k,high}$. The widths of the subbands can approximate any suitable distribution. For example the Equivalent rectangular bandwidth (ERB) scale or the Bark scale.

In some embodiments the analysis processor 105 comprises a direction analyser 203. The direction analyser 203 may be configured to receive the time-frequency signals 202 and based on these signals estimate direction parameters 108. The direction parameters may be determined based on any audio based 'direction' determination.

For example in some embodiments the direction analyser 203 is configured to estimate the direction with two or more signal inputs. This represents the simplest configuration to estimate a 'direction', more complex processing may be performed with even more signals.

The direction analyser 203 may thus be configured to provide an azimuth for each frequency band and temporal frame, denoted as azimuth φ(k,n) and elevation θ(k,n). The direction parameter 108 may be also be passed to a signal analyser 205

In some embodiments further to the direction parameter the direction analyser 203 is configured to determine an energy ratio parameter 110. The energy ratio may be considered to be a determination of the energy of the audio signal which can be considered to arrive from a direction. The direct-to-total energy ratio r(k,n) can be estimated, e.g., using a stability measure of the directional estimate, or using any correlation measure, or any other suitable method to obtain a ratio parameter.

The estimated direction 108 parameters may be output (and passed to an encoder). The estimated energy ratio parameters 110 may be passed to a signal analyser 205.

In some embodiments the analysis processor 105 comprises a signal analyser 205. The signal analyser 205 is configured to receive parameters (such as the azimuth φ(k,n) and elevation θ(k, n) 108, and the direct-to-total energy ratios r(k, n) 110) from the direction analyser 203. The signal analyser 205 may be further configured to receive the time-frequency signals ($s_i$(b,n)) 202 from the time-frequency domain transformer 201. All of these are in the time-frequency domain; b is the frequency bin index, k is the frequency band index (each band potentially consists of several bins b), n is the time index, and i is the channel.

Although directions and ratios are here expressed for each time index n, in some embodiments the parameters may be combined over several time indices. Same applies for the frequency axis, as has been expressed, the direction of several frequency bins b could be expressed by one direction parameter in band k consisting of several frequency bins b. The same applies for all of the discussed spatial parameters herein.

The signal analyser 205 is configured to produce a number of signal parameters. In the following disclosure there are the two parameters: coherence and diffuseness, both analysed in time-frequency domain. In addition, in some embodiments the signal analyser 205 is configured to modify the estimated energy ratios (r(k, n)). The signal analyser 205 is configured to generate the coherence and diffuseness parameters based on any suitable known method.

Figure 5:
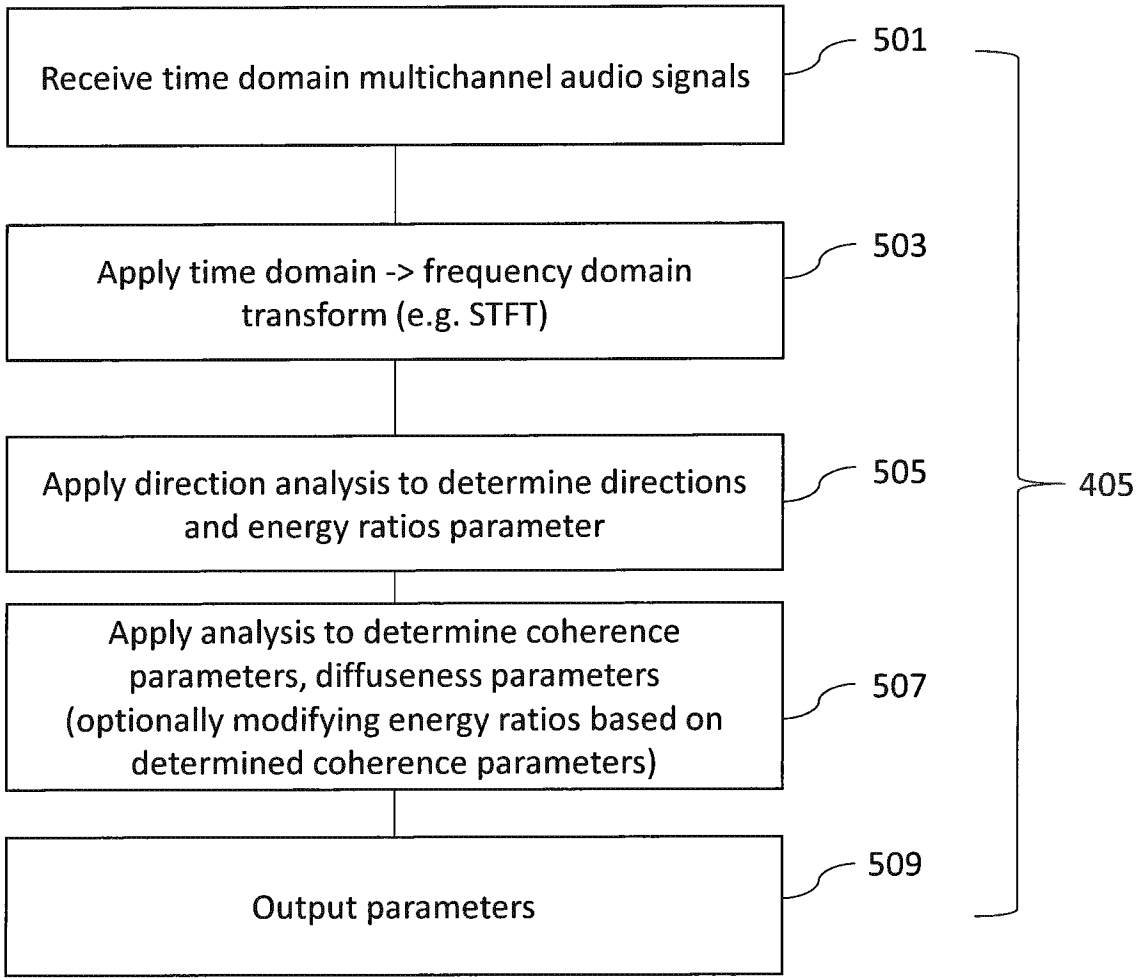
FIG. 5 shows a flow diagram of the operation of the analysis processor as shown in FIG. 2 according to some embodiments.

With respect to FIG. 5 a flow diagram summarising the operations of the analysis processor 105 are shown.

The first operation is one of receiving time domain multichannel (loudspeaker) audio signals as shown in FIG. 5 by step 501.

Following this is applying a time domain to frequency domain transform (e.g. STFT) to generate suitable time-frequency domain signals for analysis as shown in FIG. 5 by step 503.

Then applying direction analysis to determine direction and energy ratio parameters is shown in FIG. 5 by step 505.

Then applying analysis to determine coherence parameters (such as surrounding and/or spread coherence parameters) and diffuseness parameters is shown in FIG. 5 by step 507. In some embodiments the energy ratio may also be modified based on the determined coherence parameters in this step.

The final operation being one of outputting the determined parameters is shown in FIG. 5 by step 509.

Figure 3A:
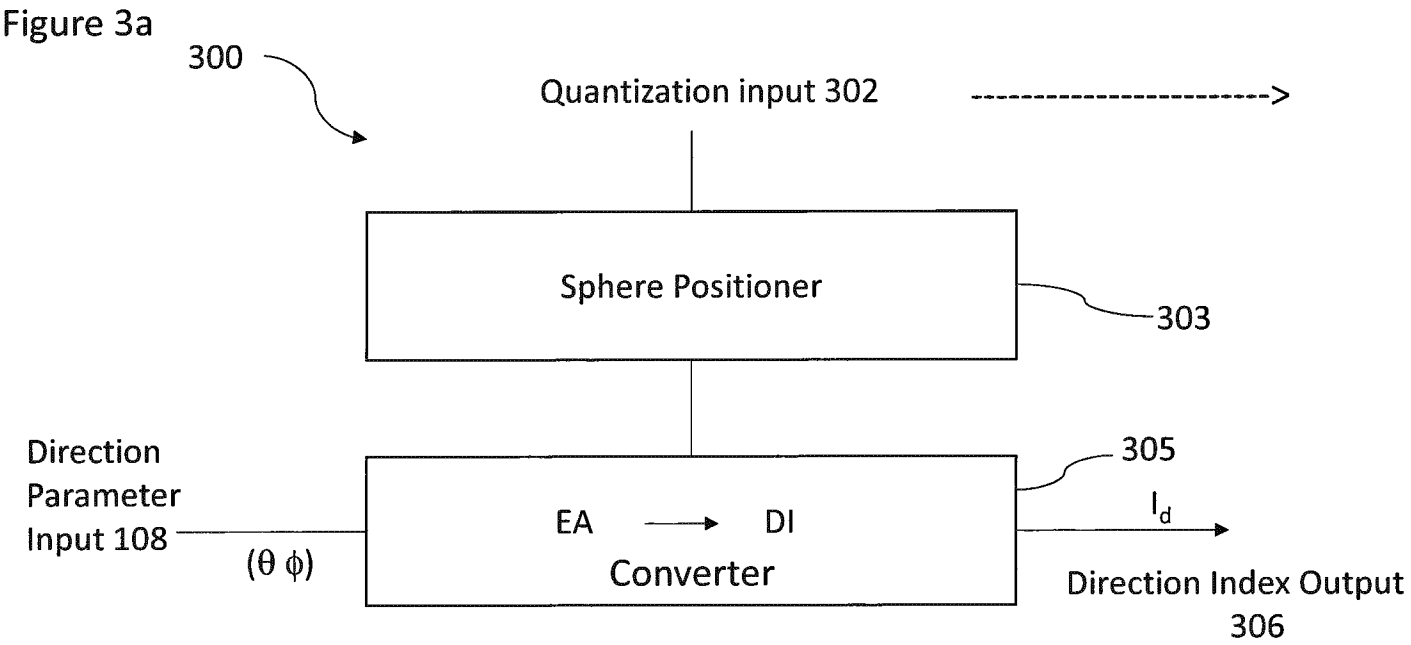
FIG. 3*a* shows schematically the metadata encoder/quantizer as shown in FIG. 1 according to some embodiments.

With respect to FIG. 3*a* an example metadata encoder and specifically the direction metadata encoder 300 is shown according to some embodiments.

The direction metadata encoder 300 in some embodiments comprises a quantization input 302. The quantization input, which may also be known as an encoding input is configured to define the granularity of spheres arranged around a reference location or position from which the direction parameter is determined. In some embodiments the quantization input is a predefined or fixed value.

The direction metadata encoder 300 in some embodiments comprises a sphere positioner 303. The sphere positioner is configured to configure the arrangement of spheres based on the quantization input value. The proposed spherical grid uses the idea of covering a sphere with smaller spheres and considering the centres of the smaller spheres as points defining a grid of almost equidistant directions.

Figure 3B:
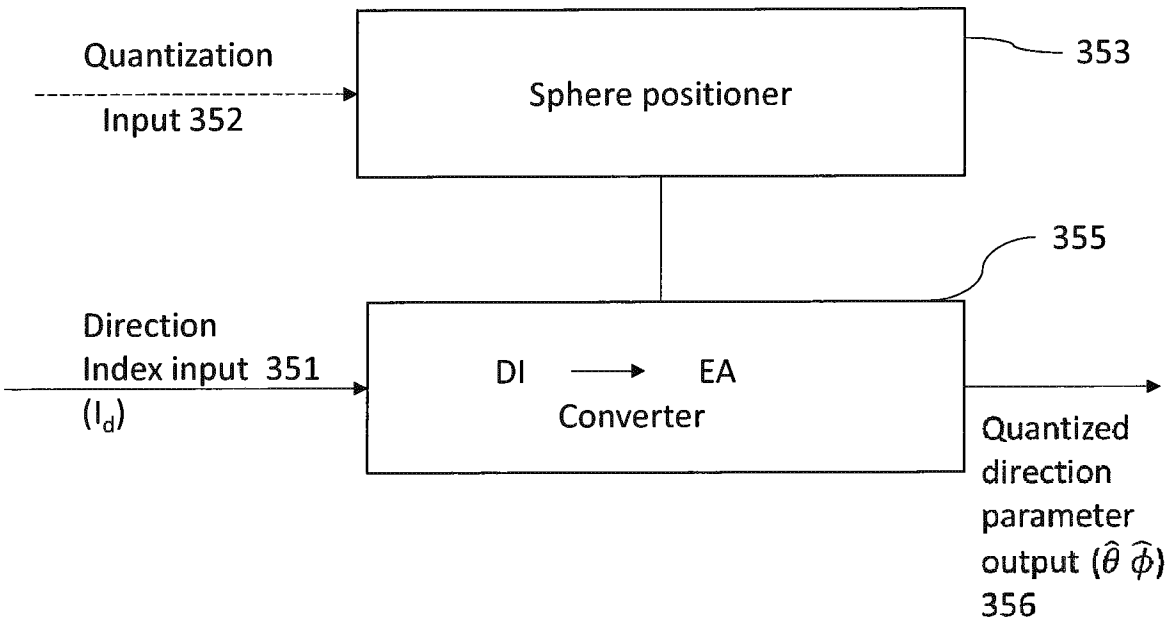
FIG. 3*b* shows schematically the metadata extractor as shown in FIG. 1 according to some embodiments.

The concept as shown herein is one in which a sphere is defined relative to the reference location. The sphere can be visualised as a series of circles (or intersections) and for each circle intersection there are located at the circumference of the circle a defined number of (smaller) spheres. This is shown for example with respect to FIGS. 3*c* to 3*e*. For example FIG. 3*c* shows an example 'equatorial cross-section' or a first main circle 370 which has a radius defined as the 'main sphere radius. Also shown in FIG. 3*c* are the smaller spheres (shown as circle cross-sections) 371, 373, 375, 377 and 379 located such that each smaller sphere has a circumference which at one point touches the main sphere circumference and at least one further point which touches at least one further smaller sphere circumference. Thus as shown in FIG. 3*c* the smaller sphere 371 touches main sphere 370 and smaller sphere 373, smaller sphere 373 touches main sphere 370 and smaller spheres 371 and 375, smaller sphere 375 touches main sphere 370 and smaller spheres 373 and 377, smaller sphere 377 touches main sphere 370 and smaller spheres 375 and 379, and smaller sphere 379 touches main sphere 370 and smaller sphere 377.

Figure 3D:
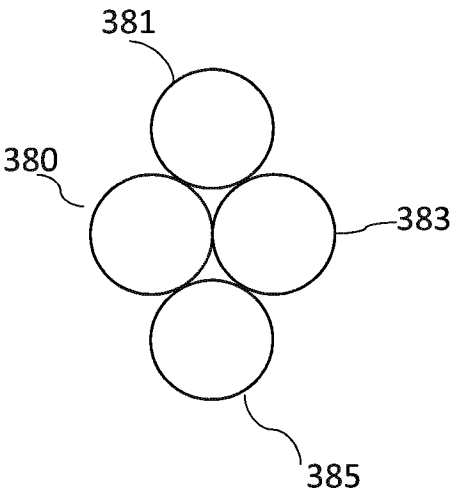
FIGS. 3*c* to 3*e* shows schematically example sphere location configurations as used in the metadata encoder/quantizer and metadata extractor as shown in FIGS. 3*a* and 3*b* according to some embodiments.
Figure 3C:
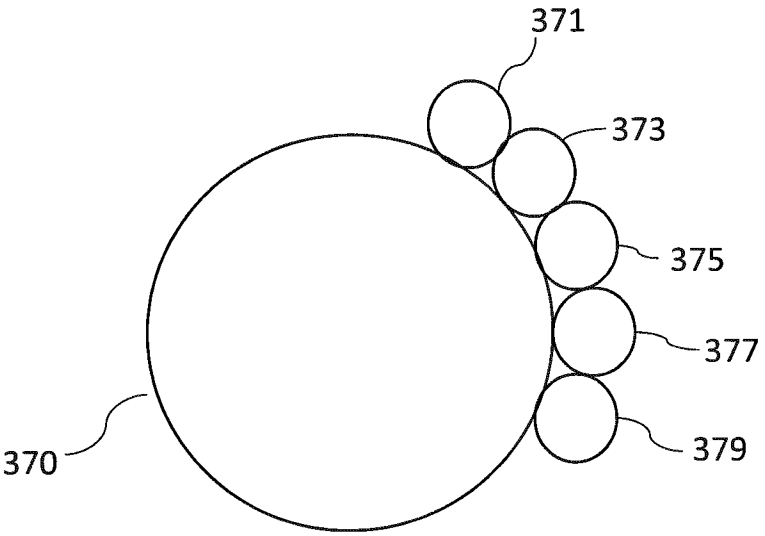

FIG. 3*d* shows an example 'tropical cross-section' or further main circle 380 and the smaller spheres (shown as circle cross-sections) 381, 383, 385 located such that each smaller sphere has a circumference which at one point touches the main sphere (circle) circumference and at least one further point which touches at least one further smaller sphere circumference. Thus as shown in FIG. 3*d* the smaller sphere 381 touches main sphere 380 and smaller sphere 383, smaller sphere 383 touches main sphere 380 and smaller spheres 381 and 385, smaller sphere 385 touches main sphere 380 and smaller sphere 383.

Figure 3E:
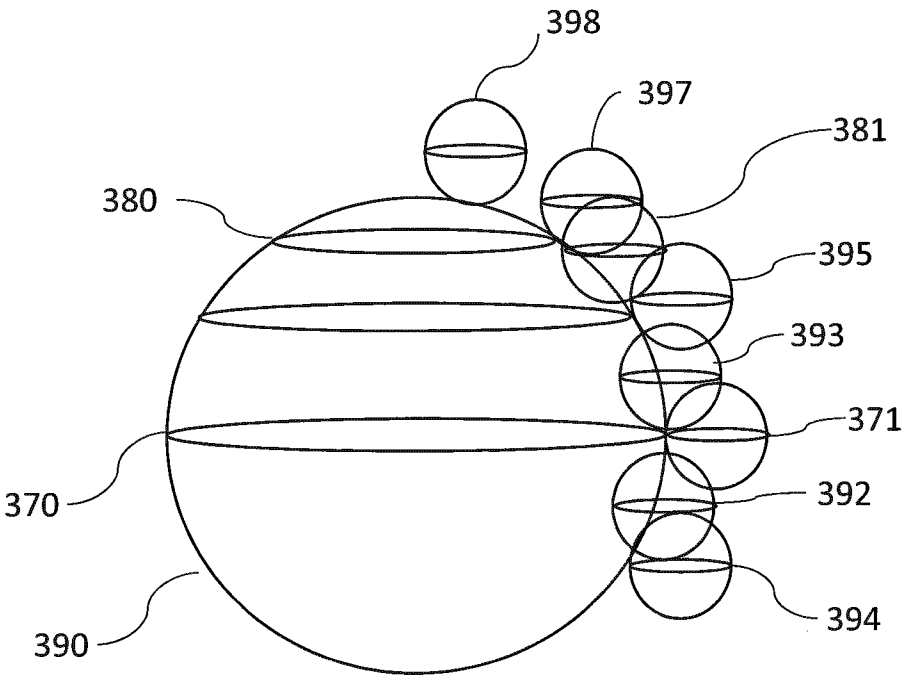

FIG. 3*e* shows an example sphere and the cross sections 370, 380 and smaller spheres (cross-sections) 371 associated with cross-section 370, smaller sphere 381 associated with cross-section 380 and other smaller spheres 392, 393, 394, 395, 397, 398. In this example only the circles with starting azimuth value at 0 are drawn.

The sphere positioner 303 thus in some embodiments be configured to perform the following operations to define the directions corresponding to the covering spheres:

---

Input: Quantization input (number of points on the "Equator", n(0)=M)

Output: number of circles, Nc, and number of points on each circle, n(i), i=0,Nc-1

1. n(0) = M

-continued

2. $\propto = \frac{2\pi}{n(0)}$

3. R(0) = 1 (radius of the circle at the Equator)
4. θ(0) = 0 (elevation)

5. $r = 2R(0)\sin\left(\frac{\alpha}{4}\right)$ (radius of the smaller spheres)

6. $\phi(0) = 0$

7. $p = \arcsin\left(r\frac{\sqrt{3}}{R(0)}\right)$

8. R(1) = R(0) cos p
9. i = 1
10. While n(i − 1) > 1
    a. $n(i) = \left\lfloor \frac{\pi R(i)}{r} \right\rfloor$ (this is valid when r<<R(0))

b. θ(i) = p · i c. $\Delta\phi(i) = \frac{\pi}{n(i-1)}$ (granularity of the azimuth on the circle i)

d. R(i +1) = R(i) cos((i +1) · p)
    e. If i is odd i. $\phi_0(i) = \frac{\Delta\phi(i)}{2}$ (first azimuth value on circle i)

f. Else
       i. $\phi_0(i) = 0$
    g. End if
    h. i = i +1
11. End while
12. Nc=i+1

Step 5 can be also replaced by $$r = 2R(0)\sin\left(\frac{\alpha}{k}\right)$$

where the factor k controls the distribution of points along the elevation. For k=4, [VA(1][GS2]the elevation resolution is approximately 1 degree. For smaller k, the resolution is correspondingly smaller.

The elevation for each point on the circle i is given by the values in θ(i). For each circle above the Equator there is a corresponding circle under the Equator.

Each direction point on one circle can be indexed in increasing order with respect to the azimuth value. The index of the first point in each circle is given by an offset that can be deduced from the number of points on each circle, n(i). In order to obtain the offsets, for a considered order of the circles, the offsets are calculated as the cumulated number of points on the circles for the given order, starting with the value 0 as first offset.

One possible order of the circles could be to start with the Equator followed by the first circle above the Equator, then the first under the Equator, the second one above the Equator, and so on.

Another option is to start with the Equator, then the circle above the Equator that is at an approximate elevation of 45 degrees and then the corresponding circle under the Equator, and then the remaining circles in alternative order. This way for some simpler positioning of loudspeakers, only the first circles are used, reducing the number of bits to send the information.

Other ordering of the circles are also possible in other embodiments.

In some embodiments the spherical grid can also be generated by considering the meridian 0 instead of the Equator, or any other meridian.

The sphere positioner having determined the number of circles and the number of circles, Nc, number of points on each circle, n(i), i=0,Nc−1 and the indexing order can be configured to pass this information to an EA to DI converter 305.

The direction metadata encoder 300 in some embodiments comprises a direction parameter input 108. The direction parameter input may define an elevation and azimuth value D=(θ,ϕ). [VA(3][GS4]

The transformation procedures from (elevation/azimuth) (EA) to direction index (DI) and back are presented in the following paragraphs. The alternative ordering of the circles is considered here.

The direction metadata encoder 300 comprises an elevation-azimuth to direction index (EA-DI) converter 305. The elevation-azimuth to direction index converter 305 in some embodiments is configured to receive the direction parameter input 108 and the sphere positioner information and convert the elevation-azimuth value from the direction parameter input 108 to a direction index to be output.

In some embodiments the elevation-azimuth to direction index (EA-DI) converter 305 is configured to perform this conversion according to the following algorithm:

Input $(\theta, \phi), \theta \in S_\theta \subset \left[-\frac{\pi}{2}, \frac{\pi}{2}\right], \phi \in S_\phi \subset [0, 2\pi]$ Output $I_d$ For a given value of Nc, the granularity, p along the elevation is known. The values θ, ϕ are from a discrete set of values, corresponding to the indexed directions. The number of point on each circle and the corresponding offset, off(i) are known.

1. Find the circle index $i = \begin{cases} 2\frac{\theta}{p} - 1, \text{ if } \theta > 0 \\ 0, \text{ if } \theta = 0 \\ -2\frac{\theta}{p}, \text{ if } \theta < 0 \end{cases}$ 2. Find the index of the azimuth within the circle $i$:

$j = \left\lfloor \frac{\phi}{\Delta\phi(i')} \right\rfloor$ where $i' = \left|\frac{\theta}{p}\right|$ 3. The direction index is $I_d = \text{off}(i) + j$ The direction index $I_d$ 306 may be output.

Figure 6:
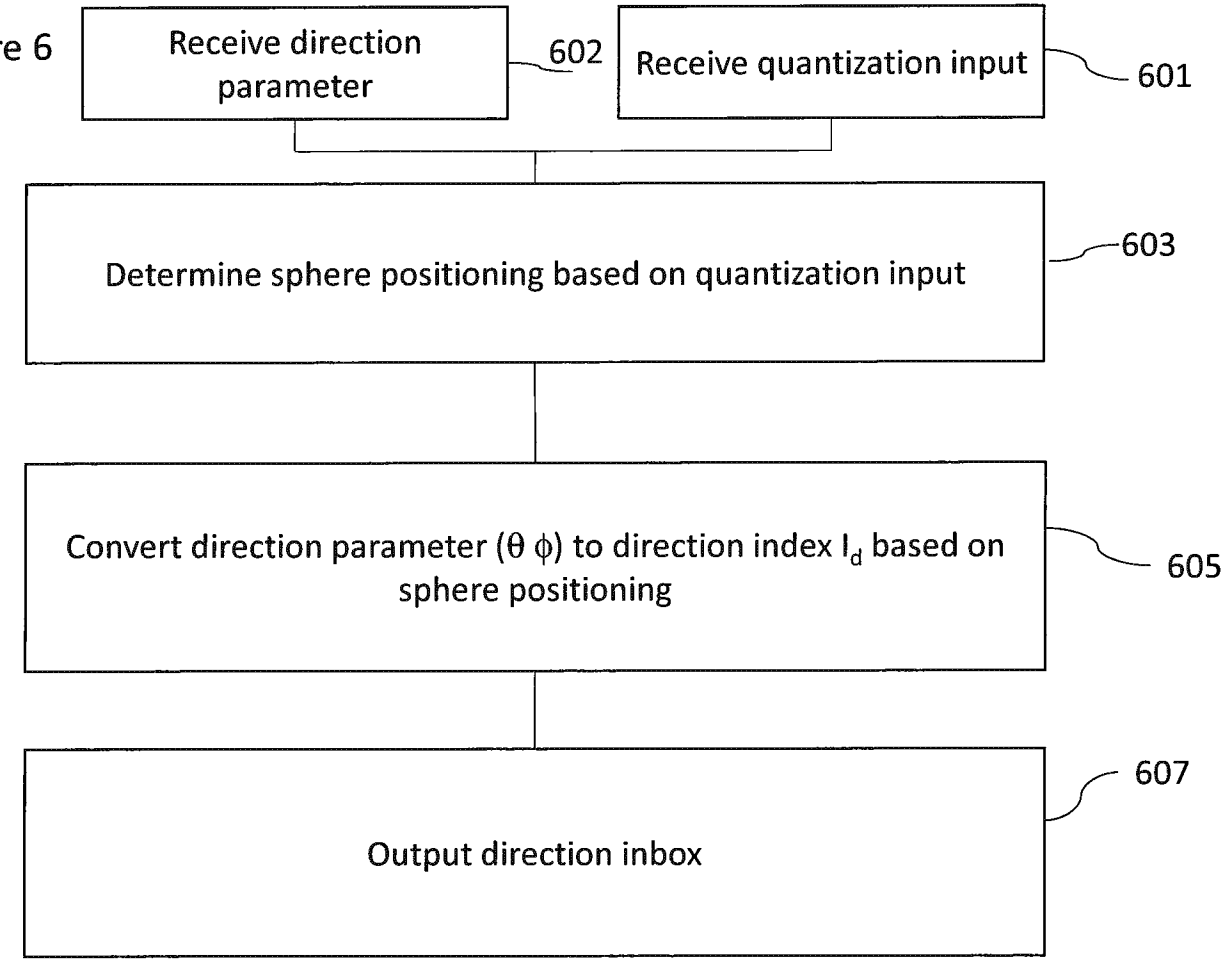
FIG. 6 shows a flow diagram of generating a direction index based on an input direction parameter in further detail.

With respect to FIG. 6 an example method for generating the direction index according to some embodiments is shown.

The receiving of the quantization input is shown in FIG. 6 by step 601.

Then the method may determine sphere positioning based on the quantization input as shown in FIG. 6 by step 603.

Also the method may comprise receiving the direction parameter as shown in FIG. 6 by step 602.

Having receiving the direction parameter and the sphere positioning information the method may comprise converting the direction parameter to a direction index based on the sphere positioning information as shown in FIG. 6 by step 605.

The method may then output the direction index as shown in FIG. 6 by step 607.

Figure 7:
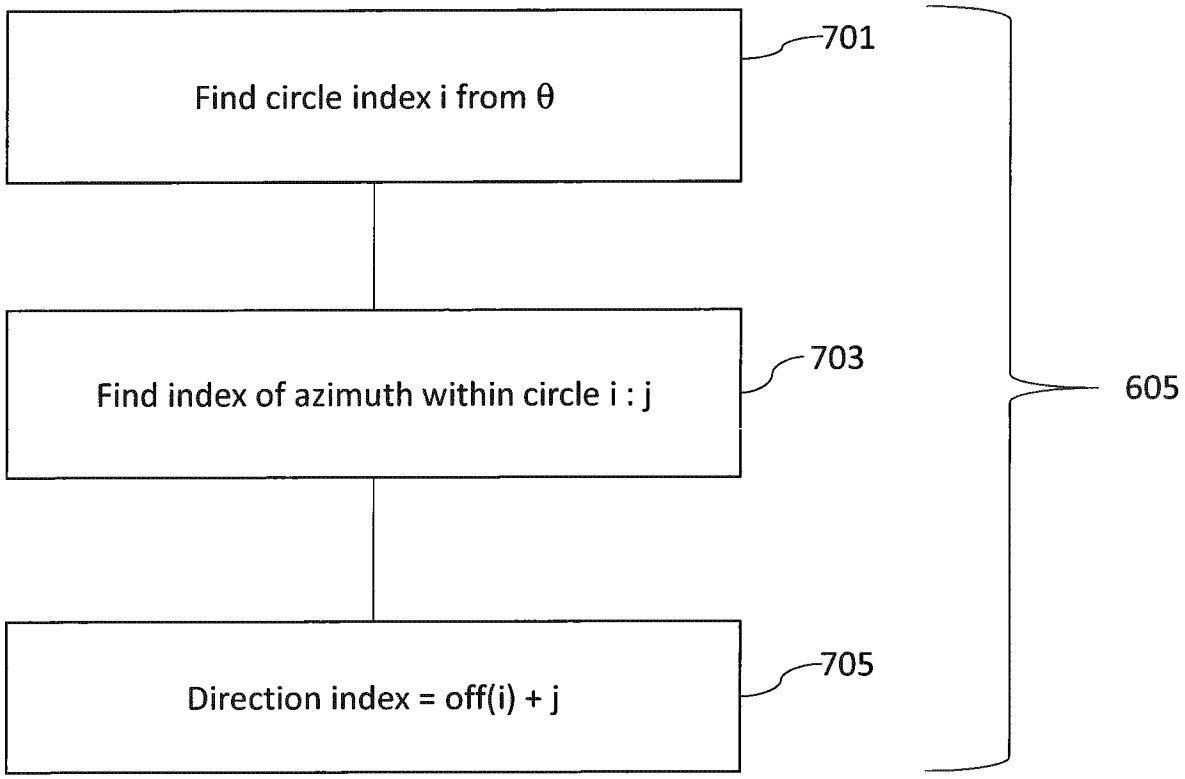
FIG. 7 shows a flow diagram of an example operation of converting a direction index from a direction parameter in further detail.

With respect to FIG. 7 an example method for converting elevation-azimuth to direction index (EA-DI), as shown in FIG. 6 by step 605, according to some embodiments is shown.

The method starts by finding the circle index i from the elevation value θ as shown in FIG. 7 by step 701.

Having determined the circle index the index of the azimuth based on the azimuth value ϕ is found as shown in FIG. 7 by step 703.

Having determined the circle index i and the index of the azimuth the direction is then determined by adding the value of the index of the azimuth to the offset associated with the circle index as shown in FIG. 7 by step 705.

With respect to FIG. 3*b* an example metadata extractor 137 and specifically a direction metadata extractor 350 is shown according to some embodiments.

The direction metadata extractor 350 in some embodiments comprises a quantization input 352. This in some embodiments is passed from the metadata encoder or is otherwise agreed with the encoder. The quantization input is configured to define the granularity of spheres arranged around a reference location or position.

The direction metadata extractor 350 in some embodiments comprises a direction index input 351. This may be received from the encoder or retrieved by any suitable means.

The direction metadata extractor 350 in some embodiments comprises a sphere positioner 353. The sphere positioner 353 is configured to receive as an input the quantization input and generate the sphere arrangement in the same manner as generated in the encoder. In some embodiments the quantization input and the sphere positioner 353 is optional and the arrangement of spheres information is passed from the encoder rather than being generated in the extractor.

The direction metadata extractor 350 comprises a direction index to elevation-azimuth (DI-EA) converter 355. The direction index to elevation-azimuth converter 355 is configured to receive the direction index and furthermore the sphere position information and generate an approximate or quantized elevation-azimuth output. In some embodiments the conversion is performed according to the following algorithm.

Input: $I_d$

Output: $(\theta, \phi)$

1. Find the circle index $i$, such that $\text{off}(i) \le I_d \le \text{off}(i+1)$ 2. Calculate the circle index in the hemisphere:

$$i' = \begin{cases} \frac{i+1}{2} & \text{if } i \text{ is odd} \\ -\frac{i}{2} & \text{if } i \text{ is even} \end{cases}$$

$$3.\ \hat{\theta} = \frac{i'}{p}$$

-continued $$4.\ \hat{\phi} = \begin{cases} \frac{I_d - \text{off}(i)}{\Delta\phi(i')}, & \text{if } i' \text{ is odd} \\ \frac{I_d - \text{off}(i)}{\Delta\phi(i')} + \frac{\Delta\phi(i')}{2}, & \text{if } i' \text{ is even} \end{cases}$$

Figure 8:
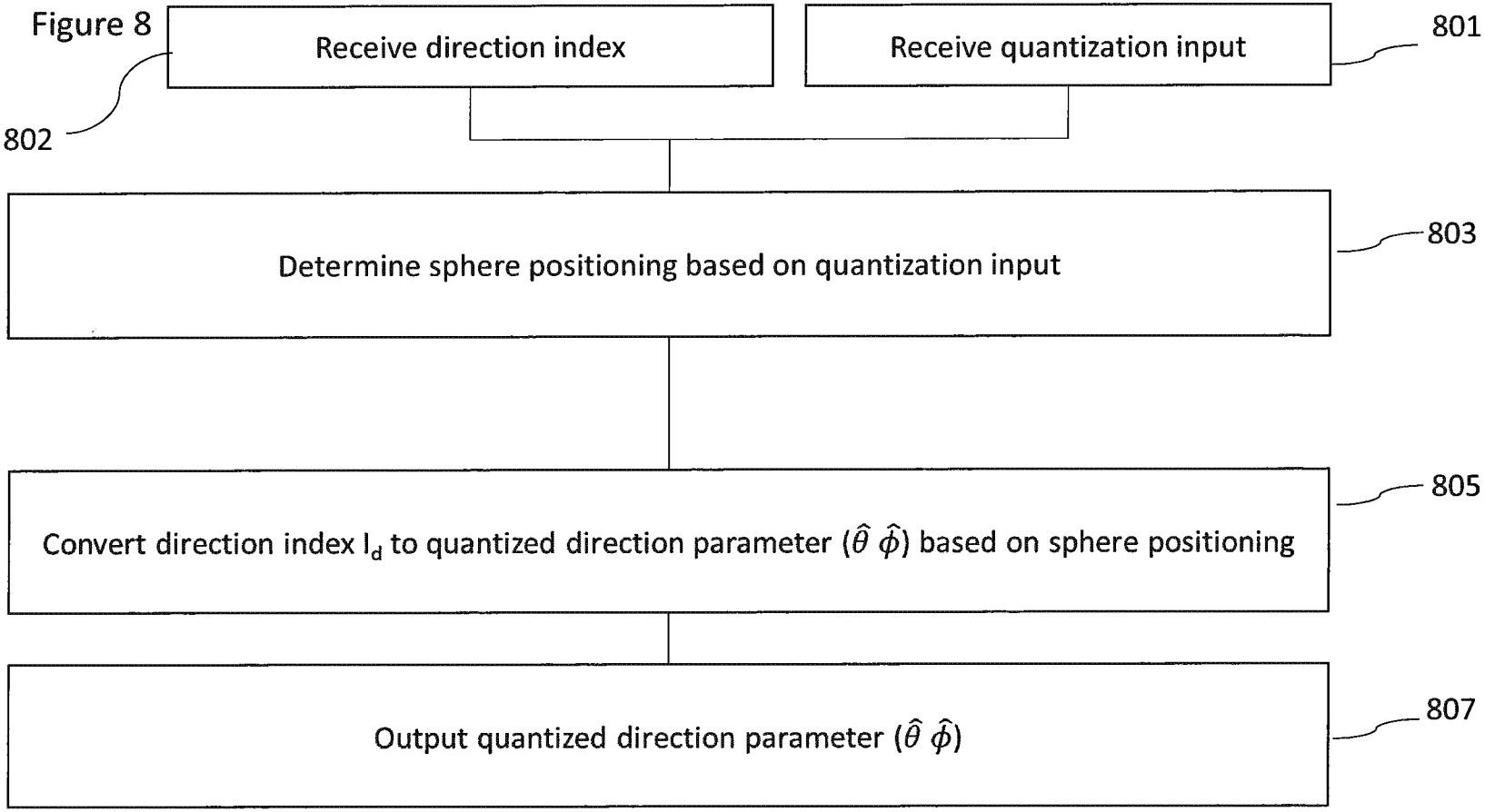
FIG. 8 shows a flow diagram of generating a quantized direction parameter based on an input direction index in further detail.

With respect to FIG. 8 an example method for extracting the direction parameters (or generating quantized direction parameters) according to some embodiments is shown.

The receiving of the quantization input is shown in FIG. 8 by step 801.

Then the method may determine sphere positioning based on the quantization input as shown in FIG. 8 by step 803.

Also the method may comprise receiving the direction index as shown in FIG. 8 by step 802.

Having received the direction index and the sphere positioning information the method may comprise converting the direction index to a direction parameter in the form of a quantized direction parameter based on the sphere positioning information as shown in FIG. 8 by step 805.

The method may then output the quantized direction parameter as shown in FIG. 8 by step 807.

Figure 9:
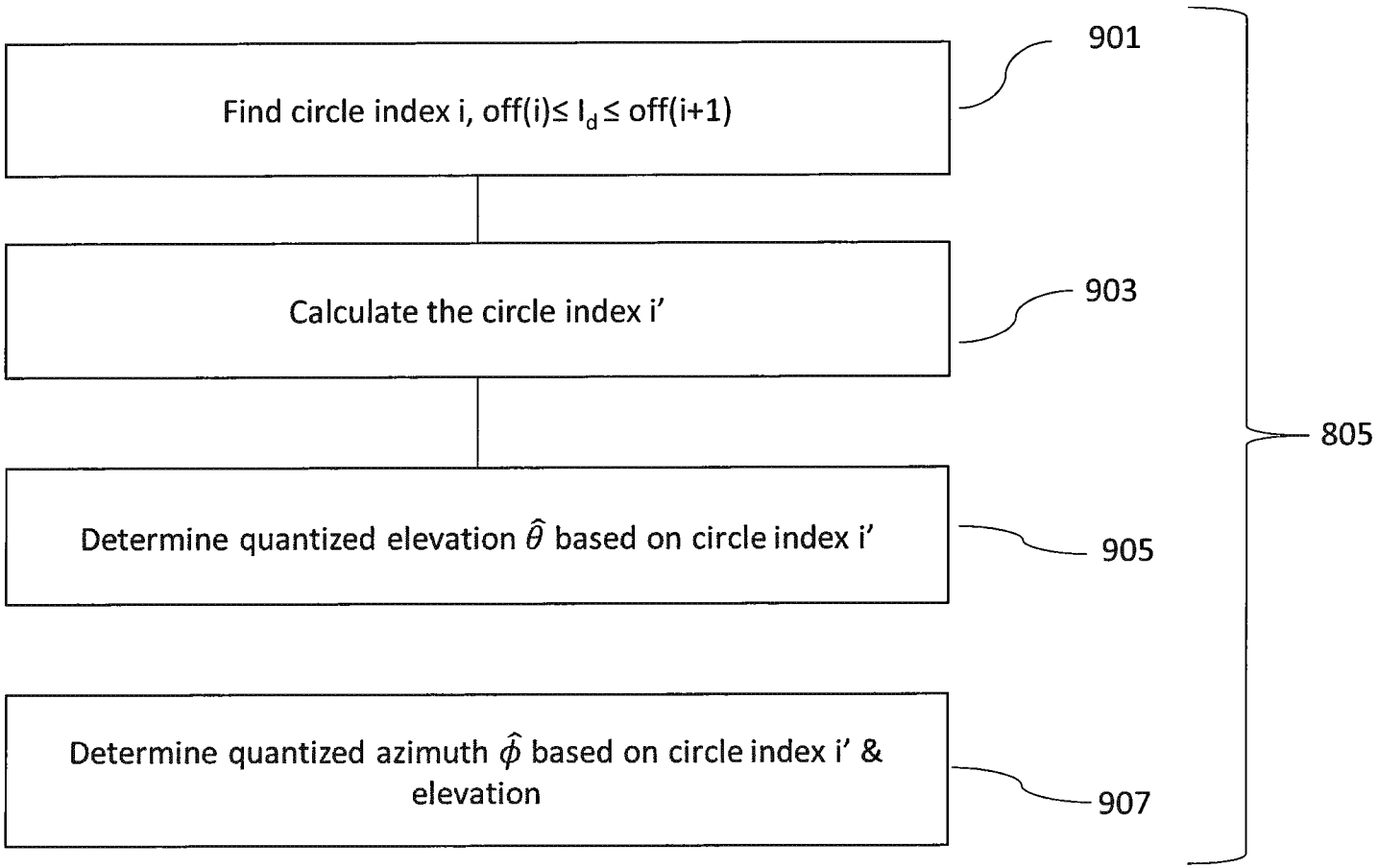
FIG. 9 shows a flow diagram of an example operation of converting a quantized direction parameter from a direction index in further detail.

With respect to FIG. 9 an example method for converting the direction index to a quantized elevation-azimuth (DI-EA) parameter, as shown in FIG. 8 by step 805, according to some embodiments is shown.

In some embodiments the method comprises finding the circle index value i such that $\text{off}(i) \le I_d \le \text{off}(i+1)$ as shown in FIG. 9 by step 901.

Having determined the circle index the next operation is to calculate the circle index in the hemisphere from the sphere positioning information as shown in FIG. 9 by step 903.

Then a quantized elevation is determined based on the circle index as shown in FIG. 9 by step 905.

Having determined the quantized elevation the quantized azimuth is determined based on the circle index and elevation information as shown in FIG. 9 by step 907.

Although not repeated throughout the document, it is to be understood that spatial audio processing, both typically and in this context, takes place in frequency bands. Those bands could be for example, the frequency bins of the time-frequency transform, or frequency bands combining several bins. The combination could be such that approximates properties of human hearing, such as the Bark frequency resolution. In other words, in some cases, we could measure and process the audio in time-frequency areas combining several of the frequency bins b and/or time indices n. For simplicity, these aspects were not expressed by all of the equations above. In case many time-frequency samples are combined, typically one set of parameters such as one direction is estimated for that time-frequency area, and all time-frequency samples within that area are synthesized according to that set of parameters, such as that one direction parameter.

The usage of a frequency resolution for parameter analysis that is different than the frequency resolution of the applied filter-bank is a typical approach in the spatial audio processing systems.

Figure 10:
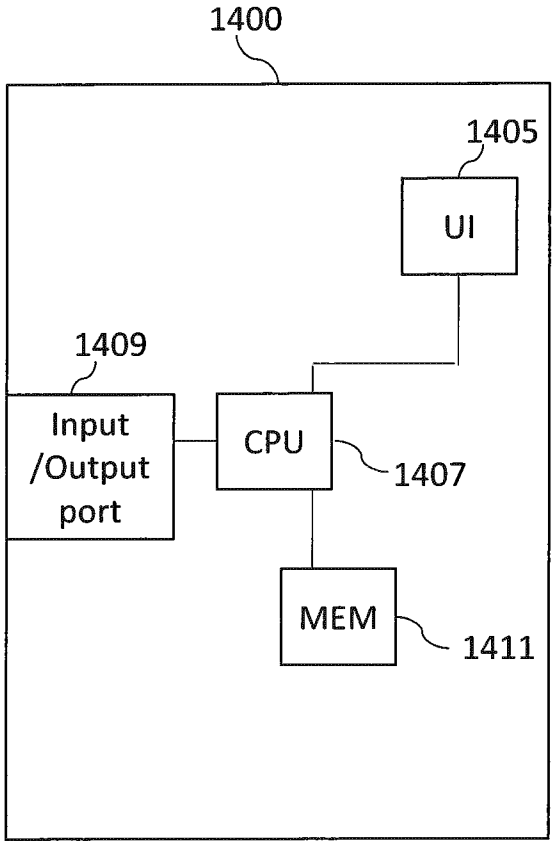
FIG. 10 shows schematically an example device suitable for implementing the apparatus shown.

With respect to FIG. 10 an example electronic device which may be used as the analysis or synthesis device is shown. The device may be any suitable electronics device or apparatus. For example in some embodiments the device 1400 is a mobile device, user equipment, tablet computer, computer, audio playback apparatus, etc.

In some embodiments the device 1400 comprises at least one processor or central processing unit 1407. The processor 1407 can be configured to execute various program codes such as the methods such as described herein.

In some embodiments the device 1400 comprises a memory 1411. In some embodiments the at least one processor 1407 is coupled to the memory 1411. The memory 1411 can be any suitable storage means. In some embodiments the memory 1411 comprises a program code section for storing program codes implementable upon the processor 1407. Furthermore in some embodiments the memory 1411 can further comprise a stored data section for storing data, for example data that has been processed or to be processed in accordance with the embodiments as described herein. The implemented program code stored within the program code section and the data stored within the stored data section can be retrieved by the processor 1407 whenever needed via the memory-processor coupling.

In some embodiments the device 1400 comprises a user interface 1405. The user interface 1405 can be coupled in some embodiments to the processor 1407. In some embodiments the processor 1407 can control the operation of the user interface 1405 and receive inputs from the user interface 1405. In some embodiments the user interface 1405 can enable a user to input commands to the device 1400, for example via a keypad. In some embodiments the user interface 1405 can enable the user to obtain information from the device 1400. For example the user interface 1405 may comprise a display configured to display information from the device 1400 to the user. The user interface 1405 can in some embodiments comprise a touch screen or touch interface capable of both enabling information to be entered to the device 1400 and further displaying information to the user of the device 1400. In some embodiments the user interface 1405 may be the user interface for communicating with the position determiner as described herein.

In some embodiments the device 1400 comprises an input/output port 1409. The input/output port 1409 in some embodiments comprises a transceiver. The transceiver in such embodiments can be coupled to the processor 1407 and configured to enable a communication with other apparatus or electronic devices, for example via a wireless communications network. The transceiver or any suitable transceiver or transmitter and/or receiver means can in some embodiments be configured to communicate with other electronic devices or apparatus via a wire or wired coupling.

The transceiver can communicate with further apparatus by any suitable known communications protocol. For example in some embodiments the transceiver or transceiver means can use a suitable universal mobile telecommunications system (UMTS) protocol, a wireless local area network (WLAN) protocol such as for example IEEE 802.X, a suitable short-range radio frequency communication protocol such as Bluetooth, or infrared data communication pathway (IRDA).

The transceiver input/output port 1409 may be configured to receive the signals and in some embodiments determine the parameters as described herein by using the processor 1407 executing suitable code. Furthermore the device may generate a suitable downmix signal and parameter output to be transmitted to the synthesis device.

In some embodiments the device 1400 may be employed as at least part of the synthesis device. As such the input/output port 1409 may be configured to receive the downmix signals and in some embodiments the parameters determined at the capture device or processing device as described herein, and generate a suitable audio signal format output by using the processor 1407 executing suitable code. The input/output port 1409 may be coupled to any suitable audio output for example to a multichannel speaker system and/or headphones or similar.

In general, the various embodiments of the invention may be implemented in hardware or special purpose circuits, software, logic or any combination thereof. For example, some aspects may be implemented in hardware, while other aspects may be implemented in firmware or software which may be executed by a controller, microprocessor or other computing device, although the invention is not limited thereto. While various aspects of the invention may be illustrated and described as block diagrams, flow charts, or using some other pictorial representation, it is well understood that these blocks, apparatus, systems, techniques or methods described herein may be implemented in, as non-limiting examples, hardware, software, firmware, special purpose circuits or logic, general purpose hardware or controller or other computing devices, or some combination thereof.

The embodiments of this invention may be implemented by computer software executable by a data processor of the mobile device, such as in the processor entity, or by hardware, or by a combination of software and hardware. Further in this regard it should be noted that any blocks of the logic flow as in the Figures may represent program steps, or interconnected logic circuits, blocks and functions, or a combination of program steps and logic circuits, blocks and functions. The software may be stored on such physical media as memory chips, or memory blocks implemented within the processor, magnetic media such as hard disk or floppy disks, and optical media such as for example DVD and the data variants thereof, CD.

The memory may be of any type suitable to the local technical environment and may be implemented using any suitable data storage technology, such as semiconductor-based memory devices, magnetic memory devices and systems, optical memory devices and systems, fixed memory and removable memory. The data processors may be of any type suitable to the local technical environment, and may include one or more of general purpose computers, special purpose computers, microprocessors, digital signal processors (DSPs), application specific integrated circuits (ASIC), gate level circuits and processors based on multi-core processor architecture, as non-limiting examples.

Embodiments of the inventions may be practiced in various components such as integrated circuit modules. The design of integrated circuits is by and large a highly automated process. Complex and powerful software tools are available for converting a logic level design into a semiconductor circuit design ready to be etched and formed on a semiconductor substrate.

Programs, such as those provided by Synopsys, Inc. of Mountain View, Calif. and Cadence Design, of San Jose, Calif. automatically route conductors and locate components on a semiconductor chip using well established rules of design as well as libraries of pre-stored design modules. Once the design for a semiconductor circuit has been completed, the resultant design, in a standardized electronic format (e.g., Opus, GDSII, or the like) may be transmitted to a semiconductor fabrication facility or "fab" for fabrication.

The foregoing description has provided by way of exemplary and non-limiting examples a full and informative description of the exemplary embodiment of this invention. However, various modifications and adaptations may become apparent to those skilled in the relevant arts in view of the foregoing description, when read in conjunction with the accompanying drawings and the appended claims. However, all such and similar modifications of the teachings of this invention will still fall within the scope of this invention as defined in the appended claims.

The invention claimed is:

1. An apparatus comprising: at least one processor and at least one memory including a computer program code, the at least one memory and the computer program code configured to, with the at least one processor, cause the apparatus at least to:

determine, for two or more audio signals, at least one spatial audio parameter for providing spatial audio reproduction, the at least one spatial audio parameter comprising an elevation and an azimuth component;

define a spherical grid generated by covering a sphere with smaller spheres by selecting a determined number of the smaller spheres for a first cross-section circle of the sphere, wherein the first cross-section circle is defined by a diameter of the sphere, determining a further number of cross-section circles of the sphere, and selecting for each of the further number of cross-section circles, the smaller spheres, wherein the smaller spheres are each smaller than the sphere, and wherein the centers of the smaller spheres define points of the spherical grid; and convert the elevation and azimuth component to an index value based on the defined spherical grid.

2. The apparatus as claimed in claim 1, wherein the first cross-section circle defined by the diameter of the sphere is one of:

an equator of the sphere;

any circle having the same center as the sphere, and being situated on the sphere surface; and a meridian of the sphere.

3. The apparatus as claimed in claim 1, wherein the apparatus caused to define a spherical grid generated by covering a sphere with smaller spheres is further caused to define a circle index order associated with the first cross-section circle and the further number of cross-section circles.

4. The apparatus as claimed in claim 1, wherein the spacing of the smaller spheres over the sphere is approximately equidistant with respect to the smaller spheres.

5. The apparatus as claimed in claim 1, wherein the determined number of the smaller spheres for a first cross-section circle of the sphere and further numbers of the smaller spheres are determined based on an input quantization value.

6. The apparatus as claimed in claim 1, wherein the apparatus caused to convert the elevation and azimuth component to the index value based on the defined spherical grid is further caused to:

determine a cross-section circle index value based on a defined order of the elevation component;

determine an intra-circle index value based on the azimuth component; and generate the index value based on combining the intra-circle index value and an offset value based on the cross-section circle index value.

7. An apparatus comprising: at least one processor and at least one memory including a computer program code, the at least one memory and the computer program code configured to, with the at least on processor, cause the apparatus at least to:

determine, at least one direction index associated with two or more audio signals for providing spatial audio reproduction, the at least one direction index representing a spatial parameter with an elevation and an azimuth component;

determine a spherical grid generated by covering a sphere with smaller spheres by selecting a determined number of the smaller spheres for a first cross-section circle of the sphere, wherein the first cross-section circle is defined by a diameter of the sphere, determining a further number of cross-section circles of the sphere, and selecting for each of the further number of cross-section circles, the smaller spheres, wherein the smaller spheres are each smaller than the sphere, and wherein the centers of the smaller spheres define points of the spherical grid;

convert the at least one direction index to a quantized elevation and a quantized azimuth representation of the elevation and the azimuth component; and convert the quantized elevation and the quantized azimuth representation of the elevation and the azimuth component to an index value based on the determined spherical grid.

8. The apparatus as claimed in claim 7, wherein the first cross-section circle defined by the diameter of the sphere is one of:

an equator of the sphere;

any circle having the same center as the sphere, and being situated on the sphere surface; and a meridian of the sphere.

9. The apparatus as claimed in claim 7, wherein the apparatus caused to define a spherical grid generated by covering a sphere with smaller spheres is further caused to define a circle index order associated with the first cross-section circle and the further number of cross-section circles.

10. The apparatus as claimed in claim 7, wherein the spacing of the smaller spheres over the sphere is approximately equidistant with respect to the smaller spheres.

11. The apparatus as claimed in claim 7, wherein the determined number of the smaller spheres for a first cross-section circle of the sphere and further numbers of the smaller spheres as determined based on an input quantization value.

12. The apparatus as claimed in claim 7, wherein the apparatus caused to convert the quantized elevation and the quantized azimuth representation of the elevation and the azimuth component to the index value based on the determined spherical grid is further caused to:

determine a cross-section circle index value based on the index value;

determine the quantized elevation representation of the elevation component based on the cross-section circle index value; and generate the quantized azimuth representation of the azimuth component based on a reminder index value after removing an offset associated with the cross-section circle index value from the index value.

13. A method comprising:

determining, for two or more audio signals, at least one spatial audio parameter for providing spatial audio reproduction, the at least one spatial audio parameter comprising an elevation and an azimuth component;

defining a spherical grid generated by covering a sphere with smaller spheres by selecting a determined number of the smaller spheres for a first cross-section circle of the sphere, wherein the first cross-section circle is defined by a diameter of the sphere, determining a further number of cross-section circles of the sphere, and selecting for each of the further number of cross-section circles, the smaller spheres, wherein the smaller spheres are each smaller than the sphere, and wherein the centers of the smaller spheres define points of the spherical grid; and converting the elevation and azimuth component to an index value based on the defined spherical grid.

14. The apparatus as claimed in claim 13, wherein the first cross-section circle defined by the diameter of the sphere is one of:

an equator of the sphere;

any circle having the same center as the sphere, and being situated on the sphere surface; and a meridian of the sphere.

15. A method comprising:

determining the at least one direction index associated with two or more audio signals for providing spatial audio reproduction, the at least one direction index representing a spatial parameter comprising an elevation and an azimuth component;

determining a spherical grid generated by covering a sphere with smaller spheres by selecting a determined number of the smaller spheres for a first cross-section circle of the sphere, wherein the first cross-section circle is defined by a diameter of the sphere, determining a further number of cross-section circles of the sphere, and selecting for each of the further number of cross-section circles, the smaller spheres, wherein the smaller spheres are each smaller than the sphere, and wherein the centers of the smaller spheres define points of the spherical grid;

converting the at least one direction index to a quantized elevation and a quantized azimuth representation of the elevation and the azimuth component; and converting the quantized elevation and the quantized azimuth representation of the elevation and the azimuth component to an index value based on the determined spherical grid.

16. The apparatus as claimed in claim 15, wherein the first cross-section circle defined by the diameter of the sphere is one of:

an equator of the sphere;

any circle having the same center as the sphere, and being situated on the sphere surface; and a meridian of the sphere.

17. An apparatus comprising: at least one processor and at least one memory including a computer program code, the at least one memory and the computer program code configured to, with the at least one processor, cause the apparatus at least to:

determine, for two or more audio signals, at least one spatial audio parameter for providing spatial audio reproduction, the at least one spatial audio parameter comprising an elevation and an azimuth component;

define a spherical grid generated by covering a sphere with smaller spheres, wherein the smaller spheres are each smaller than the sphere, and wherein the centers of the smaller spheres define points of the spherical grid; and convert the elevation and azimuth component to an index value based on the defined spherical grid by:

determining a cross-section circle index value based on a defined order of the elevation component;

determining an intra-circle index value based on the azimuth component; and generating the index value based on combining the intra-circle index value and an offset value based on the cross-section circle index value.

18. A method comprising:

determining, for two or more audio signals, at least one spatial audio parameter for providing spatial audio reproduction, the at least one spatial audio parameter comprising an elevation and an azimuth component;

defining a spherical grid generated by covering a sphere with smaller spheres, wherein the smaller spheres are each smaller than the sphere, and wherein the centers of the smaller spheres define points of the spherical grid; and converting the elevation and azimuth component to an index value based on the defined spherical grid by:

determining a cross-section circle index value based on a defined order of the elevation component;

determining an intra-circle index value based on the azimuth component; and generating the index value based on combining the intra-circle index value and an offset value based on the cross-section circle index value.

19. An apparatus comprising: at least one processor and at least one memory including a computer program code, the at least one memory and the computer program code configured to, with the at least on processor, cause the apparatus at least to:

determine, at least one direction index associated with two or more audio signals for providing spatial audio reproduction, the at least one direction index representing a spatial parameter with an elevation and an azimuth component;

determine a spherical grid generated by covering a sphere with smaller spheres, wherein the smaller spheres are each smaller than the sphere, and wherein the centers of the smaller spheres define points of the spherical grid;

convert the at least one direction index to a quantized elevation and a quantized azimuth representation of the elevation and the azimuth component; and convert the quantized elevation and the quantized azimuth representation of the elevation and the azimuth component to an index value based on the determined spherical grid by:

determining a cross-section circle index value based on the index value;

determining the quantized elevation representation of the elevation component based on the cross-section circle index value; and generating the quantized azimuth representation of the azimuth component based on a reminder index value after removing an offset associated with the cross-section circle index value from the index value.

20. A method comprising:

determining, at least one direction index associated with two or more audio signals for providing spatial audio reproduction, the at least one direction index representing a spatial parameter with an elevation and an azimuth component;

determining a spherical grid generated by covering a sphere with smaller spheres, wherein the smaller spheres are each smaller than the sphere, and wherein the centers of the smaller spheres define points of the spherical grid;

converting the at least one direction index to a quantized elevation and a quantized azimuth representation of the elevation and the azimuth component; and converting the quantized elevation and the quantized azimuth representation of the elevation and the azimuth component to an index value based on the determined spherical grid by:

determining a cross-section circle index value based on the index value;

determining the quantized elevation representation of the elevation component based on the cross-section circle index value; and generating the quantized azimuth representation of the azimuth component based on a reminder index value after removing an offset associated with the cross-section circle index value from the index value.

* * * * *